US005826581A

United States Patent [19]

Yoshida

[11] Patent Number: 5,826,581

[45] Date of Patent: Oct. 27, 1998

[54] ATHLETE'S MOLAR PROTECTOR

[76] Inventor: Nobutaka Yoshida, 2-9-18, Nihonbashi, Chuoku, Osaka, Japan

[21] Appl. No.: 848,884

[22] Filed: May 1, 1997

[30] Foreign Application Priority Data

Aug. 8, 1996 [JP] Japan ..... 8-227832

[51] Int. Cl.[6] ..... A61C 5/12

[52] U.S. Cl. ..... 128/859; 128/861; 128/862

[58] Field of Search ..... 128/848, 859–862; 433/6, 36

[56] References Cited

U.S. PATENT DOCUMENTS

| | | | |
|---|---|---|---|
| 3,223,085 | 12/1965 | Gores | 128/861 |
| 4,765,324 | 8/1988 | Lake | 128/861 |
| 5,339,832 | 8/1994 | Kittelsen | 128/861 |
| 5,566,684 | 10/1996 | Wagner | 128/861 |

*Primary Examiner*—Michael A. Brown
*Attorney, Agent, or Firm*—Lockwood, Alex, FitzGibbon & Cummings

[57] ABSTRACT

A molar protector comprising a pair of right and left molar protecting portions (1) each having faces complementary to the occlusal faces of the corresponding superior and inferior maxillary molars and a connecting portion (3) bridging said molar protecting portions (1), each of said molar protecting portions comprising a top layer, a bottom layer, and an intermediate layer lying between said top and bottom layers, said top layer and bottom layer being respectively made of an easily softenable material, the softening point of which is higher than human body temperature and lower than the boiling point of water, such as a thermoplastic resin, and said intermediate layer being made of an elastic, hardly softenable material which does not soften at temperatures below the boiling point of water, such as elastomer, silicone rubber, synthetic rubber, silicone resin, or high-temperature thermoplastic resin.

6 Claims, 7 Drawing Sheets

ATHLETE'S MOLAR PROTECTOR

BACKGROUND OF THE INVENTION

1. Field of the Invention

This invention relates to an athlete's molar protector to be worn in the oral cavity by a professional athlete, an amateur sportsman, or a person about to carry a heavy load for the protection of the molars at physical exertions.

2. Description of the Related Art

In physical activities in general, such as golf, baseball, a track event, etc., the timing and state of exertion such as concentration and quick release of muscular forces vary with different kinds of activities but it is common to all types of physical exercise that the person who does an exercise or carries a heavy load clenches the molars of upper and lower jaws with a great momentary force.

While the concentration and instantaneous release of muscle power are closely related to the clenching of one's molars in timing and magnitude, a repeated or prolonged spell of such clenching of molars may result in the mutual abrasion or breakage of the molars. If this happens, one will be no longer able to concentrate and release forces effectively or have to have the loosened molars extracted. If a professional athlete continues to be engaged in exercises in that condition, he may sooner or later have to abandon the status of being a professional. Furthermore, it has been medically established that the resulting disturbance of occlusion is causative of serious morbidities such as lumbago, stiff shoulders, and other nervous system disorders. The tendency is that these untoward events occur more often in professional athletes than in amateur sportsmen and, among professionals, more often in high-ranking athletes than in athletes of the average caliber.

For these reasons, it is common practice for athletes, particularly professionals, to wear a template for protecting their molars so as to preclude such serious outcomes.

The template mentioned above is a modification of the clinical template fabricated exclusively by the dentist for his patient, that is the template (occlusal pattern) used for visualizing the state of occlusal, and is generally custom-made at a dental clinic in accordance with the following protocol.

(1) First, the dentist takes an impression of the dentition of the upper and lower jaws and, using bite wax (a wax for bite taking), establishes the occlusal positions of the superior and inferior maxillary molars of the person who is to wear the template. Then, he sets the wax in an articulator to take a wax pattern (template pattern). (2) This template pattern is cast in a plaster investing material which is then cured. (3) The cured plaster material is split into an upper segment and a lower segment and heated to melt away the pattern wax (dewaxing) to provide the upper and lower plaster molds. (4) An acrylic resin is then introduced into the upper and lower molds and heated to cure in situ. (5) The acrylic resin template thus produced is released from the molds and polished. (6) Finally this template is adjusted against the die and fitted into the oral cavity of the person who is to wear the template. The dentist checks the template for fitness and makes fine adjustments to complete a finished template.

However, the above architecture of the molar protector and fabrication process have several disadvantages as will be discussed below and further improvements for a complete solution to the abovementioned problems have been demanded.

(1) The fabrication process involves many steps which are time-consuming and the person to wear the molar protector is obliged to visit the dental clinic a number of times until the finished product becomes available, thus making the fabrication of a template a tedious and difficult work. Therefore, the conventional template is not broadly used but has been used only by certain cohorts of professional athletes for whom wearing a molar protector is absolutely necessary.

(2) Since the fabrication process calls for special art and skill, it is inevitable that the finished accuracy varies from one maker to another. Moreover, since the process involves a large number of steps, it is difficult to provide the optimum molar protector closely fitting to the dental formation of the wearer.

(3) The large number of steps involved and the high degree of skill required inevitably lead to high manufacturing costs.

(4) The conventional acrylic resin template is fairly high in finished hardness so that even if the template is well fitting to the dentition of the wearer, it is not elastic enough, with the result that, when used repeately or for a long time, it may adversely affect the molars, for example, chipping them.

(5) For the above reasons (1) through (4), especially the rate of utilization of molar protectors by the sporting public who regard physical exercises as sorts of passtime is low.

Designed to overcome the above disadvantages of the prior art, this invention has for its object to provide an athlete's molar protector which can be easily fabricated and made available not only to professional athletes but also to amateur sportsmen, does not require much time or skill for manufacture, can be adapted by the wearer to his own dental conformation, and can be depended upon in the protection of molars even when used repeatedly over a long time.

SUMMARY OF THE INVENTION

The above object has been accomplished by the molar protector of this invention, which comprises a pair of right and left molar protecting portions each having top and bottom faces complementary to the occlussal faces of the corresponding superior and inferior maxillary molars, respectively, and a connecting portion bridging said molar protecting portions, each of said molar protecting portions comprising a top layer, a bottom layer, and an intermediate layer interposed between said top and bottom layers, each of said top and bottom layers being made of an easily softenable material, such as a thermoplastic resin, the softening point of which is higher than human body temperature and lower than the boiling point of water, and said intermediate layer being made of an elastic, yet hardly softenable material which does not soften at temperatures below the boiling point of water, such as elastomer, silicone rubber, synthetic rubber, silicone resin, high-temperature thermoplastic resin, or the like.

In another aspect, this invention is directed to a molar protector comprising a pair of right and left molar protecting portions each having top and bottom faces complementary to the occlusal faces of molars and a connecting portion bridging said molar protecting portions, each of said molar protecting portions comprising a top layer and a bottom layer, one of which is made of an easily softenable material, such as thermoplastic resin, the softening point of which is higher than human body temperature and lower than the boiling point of water, with the other layer being made of an elastic, hardly softenable material which does not soften at temperatures below the boiling point of water, such as elastomer, silicone rubber, synthetic rubber, silicone resin, or high-temperature thermoplastic resin.

In a further aspect, this invention is directed to a method of manufacturing a molar protector having a pair of right and left molar protecting portions each having top and bottom faces complementary to the occlusal faces of the corresponding superior and inferior maxillary molars and a connecting portion bridging said molar protecting portions, which comprises forming said molar protecting portions from an easily softenable material, the softening point of which is higher than human body temperature and lower than the boiling point of water, such as thermoplastic resin, with provision of an internal void and filling the void with an elastic, hardly softenable material which does not soften at temperatures below the boiling point of water, such as elastomer, silicone rubber, synthetic rubber, silicone resin, or high-temperature thermoplastic resin.

In a still another aspect, this invention is directed to a method of producing a molar protector having a pair of right and left molar protecting portions each having top and bottom faces complementary to the occlusal faces of the corresponding superior and inferior maxillary molars and a connecting portion bridging said molar protecting portions, which comprises molding said molar protecting portions each with provision of a laterally open void in an intermediate layer thereof from an easily softenable material, the softening point of which is higher than human body temperature and lower than the boiling point of water, such as thermoplastic resin and filling said laterally open void with an elastic, hardly softenable material which does not soften at temperatures below the boiling point of water, such as elastomer, silicone rubber, synthetic resin, silicone resin, or high-temperature thermoplastic resin.

To use the molar protector of the invention, the molar protector fabricated above is first immersed in hot water heated at the softening temperature of, for example, about 80° C. for a predetermined time to soften its layer or layers made of an easily softenable material, e.g. thermoplastic resin. Then, this locally softened molar protector is fitted into the oral cavity of the person who is to wear the molar protector. In this operation, the right and left molar protecting portions are abutted against the bilateral molars of the lower jaw and the connecting portion against the posterior (labial) side of the anterior teeth of the lower jaw and pressed with fingers to achieve intimate contact.

Then, the wearer himself clenches the upper and lower jaws in the above condition to thereby deform the softened top and bottom layers of the right and left molar protecting portions and shape the molar protector into a configuration complementary to the conformation of the superior and inferior maxillary molars. Since the intermediate layer is made of an elastic, hardly softenable material which does not soften at temperatures below the boiling point of water, such as elastomer, silicone rubber, synthetic rubber, silicone resin, or high-temperature thermoplastic resin, there is no fear of biting off the molar protector even if the wearer clenches his molars very forcefully and definite prints of the molars can be formed in the easily softenable layer made of, for example, said thermoplastic resin.

This molding operation at the use stage is hereinafter referred to as wear-molding in order to differentiate it clearly from the molding operation at the stage of manufacture of the molar protector.

The wear-molded molar protector is cured by cooling to a temperature below the softening temperature and fitted into the oral cavity for use.

To use this athlete's molar protector of the invention, the top or bottom layer made of an easily softenable material, e.g. a thermoplastic resin, is softened in hot water and with the softened layer abutted against the bilateral molars, the molars are clenched forcefully to tailor the surface of the layer to the molars.

In this aspect of the invention, wherein one of the top and bottom layers is made of an easily softenable material with the other made of a hardly softenable material, the molar protector fits the molars of either the upper jaw or the lower jaw but since the other layer is not formed with prints of molars, the molars are permitted to slide laterally even while the molar protector is worn so that the molar protector can be continuously retained in position over many hours of sporting activity.

DETAILED DESCRIPTION OF THE PREFERRED EMBODIMENTS

Figure 9:
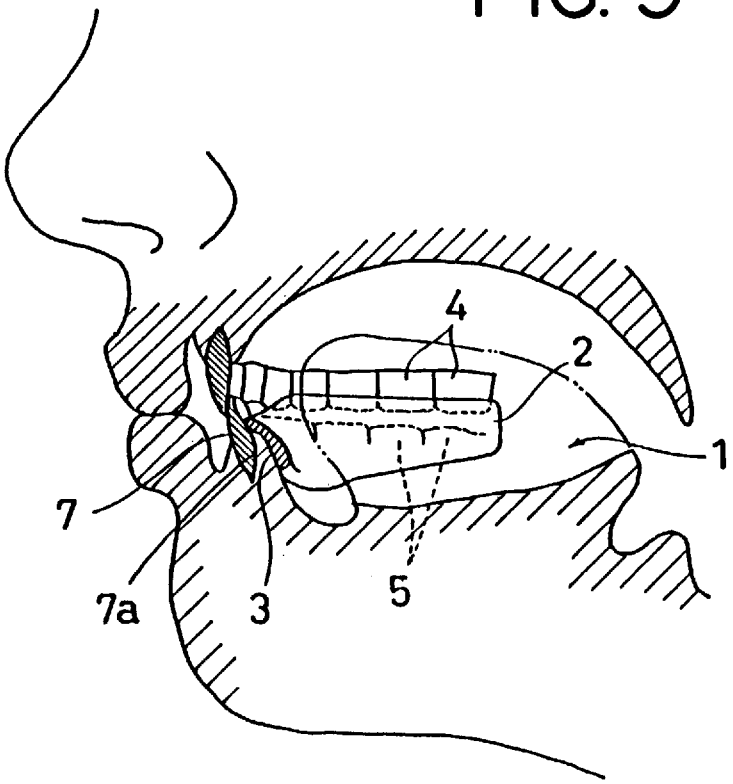
FIG. 9 is a side elevation view, in partial section, of the wear-molded state and the state in use of the molar protector of the invention.

The molar protector 1 of the invention which comprises a pair of bilateral molar protecting portions 2, 2, and a connecting portion 3 is used after being wear-molded to the dental configuration of an individual who is to wear it and set in position between the superior and posterior molars firmly clenched as shown in FIG. 9.

Figure 1:
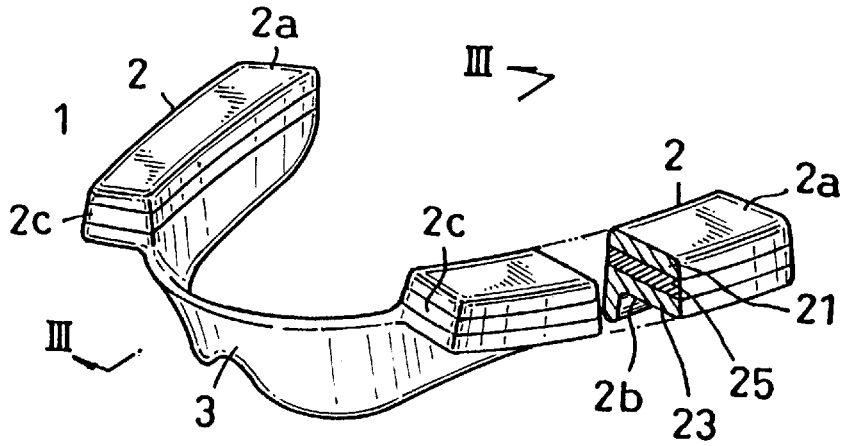
FIG. 1 is a partially exploded perspective view of the athlete's molar protector according to one embodiment of the invention.
Figure 4:
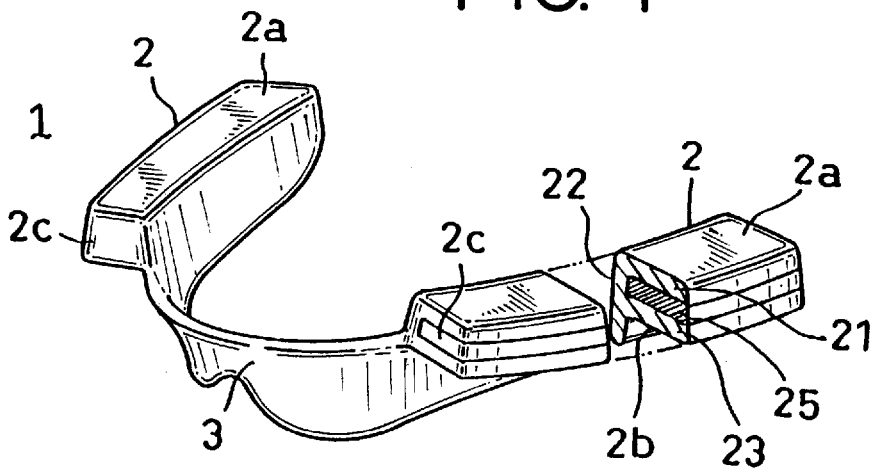
FIG. 4 is a partially exploded perspective view of the molar protector according to a second embodiment of the invention.
Figure 5:
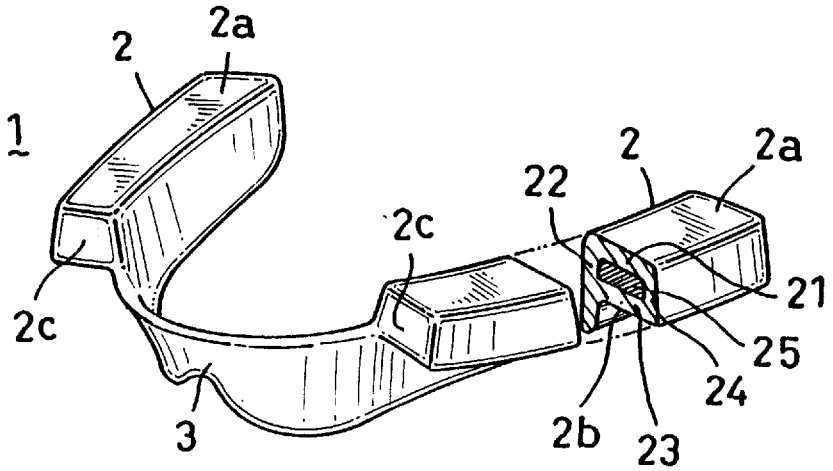
FIG. 5 is a partially exploded perspective view of the molar protector according to a third embodiment of the invention.
Figure 6:
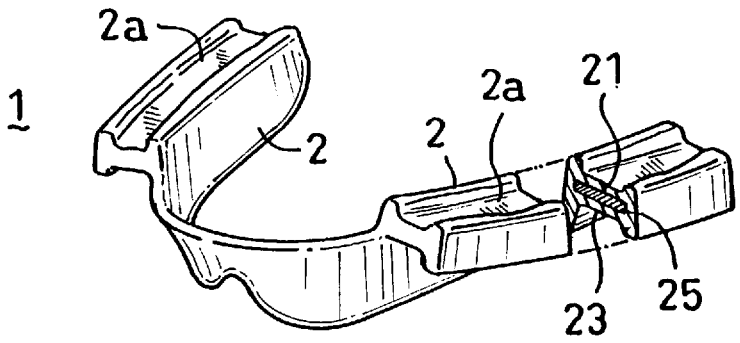
FIG. 6 is a partially exploded perspective view after wear molding of the molar protector according to said third embodiment of the invention.

Referring to FIGS. 1, 4, and 5, the molar protecting portions of the molar protector according to the first aspect of the invention each comprises a three-layer structure consisting of a top layer 21, a bottom layer 23, and an intermediate layer 25, said top and bottom layers 21, 23 being made of an easily softenable material, the softening point of which is higher than human body temperature and lower than the boiling point of water, such as a thermoplastic resin, and said intermediate layer 25 being made of a hardly softenable material which does not soften at temperatures below the boiling point of water.

The molar protector according to this first aspect of the invention includes the mode illustrated in FIG. 1, wherein said intermediate layer 25 made of hardly softenable material is simply sandwiched between said upper and bottom layers 21, 23 which are made of easily softenable material, the mode illustrated in FIG. 4 wherein the inside margin 22 of said intermediate layer 25 of hardly softenable material is made of the same easily softenable material as the top and bottom layers 21, 23 and contiguous with the latter-layers, and the mode illustrated in FIG. 5 wherein the inside and outside margins 22, 24 of the intermediate layer 25 of hardly softenable material is made of the same easily softenable material as the top and bottom layers 21, 23 and contiguous with the latter layers in such a manner that the intermediate layer 25 is completely surrounded by the same easily softenable material.

Figure 7:
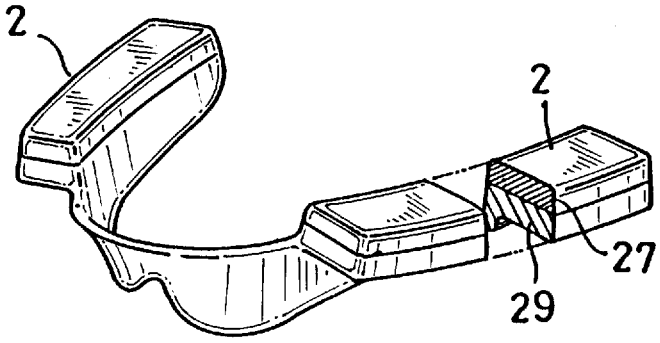
FIG. 7 is a partially exploded perspective view of the molar protector according to a fourth embodiment of the invention.

A second embodiment of the molar protecting portion is of the two-layer structure. This embodiment includes the structure illustrated in FIG. 7, which consists of a top layer 27 and a bottom layer 29, said top layer 27 being made of a hardly softenable material which does not soften at temperatures below the boiling point of water, such as elastomer, silicone rubber, synthetic rubber, silicone resin, or a high-temperature thermoplastic resin, and said bottom layer 29 being made of an easily softenable material such as thermoplastic resin, the softening point of which is higher than human body temperature and lower than the boiling point of water.

Figure 8:
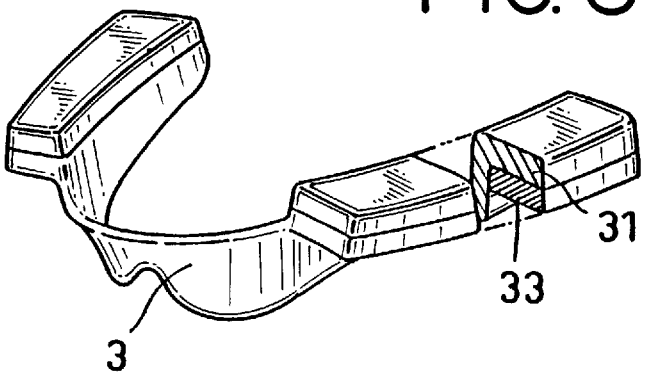
FIG. 8 is a partially exploded perspective view of the molar protector according to a fifth embodiment of the invention.

Another example of the molar protecting portion of two-layer construction is the structure illustrated in FIG. 8, which comprises a top layer 31 and a bottom layer 33, said top layer 31 being made of an easily softenable material such as a thermoplastic resin having a softening point which is higher than human body temperature and lower than the boiling point of water and said bottom layer 33 being made of a hardly softenable material which does not soften at temperatures below the boiling point of water, such as elastomer, silicone rubber, synthetic rubber, silicone resin, or high-temperature thermoplastic resin.

In any of the above-mentioned embodiments, the connecting portion is preferably made of an easily softenable material.

This invention is now described in further detail with reference to several views of the accompanying drawing.

Figure 10:
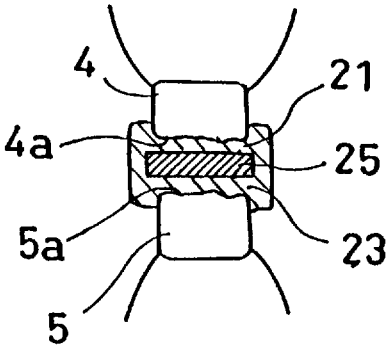
FIG. 10 is a sectional view showing the state of the same molar protector in wear-molding and in use.

The molar protector 1 comprises a pair of right and left molar protecting portions 2, 2 and a connecting portion 3. The protector 1 is used after being wear-molded to the dental conformation of an individual person who is to wear the protector (FIG. 10) and set in position between the superior and inferior maxillary molars 4, 5 firmly clenched as shown in FIG. 9.

When the molar protecting portion is of three-layer construction, the top and bottom layers of the portion are made of an easily softenable material such as thermoplastic resin having a softening point which is higher than human body temperature and lower than the boiling point of water. When the molar protecting portion is of two-layer construction, one of the layers is made of an easily softenable material such as thermoplastic resin having a softening point which is higher than human body temperature and lower than the boiling point of water.

Figure 2:
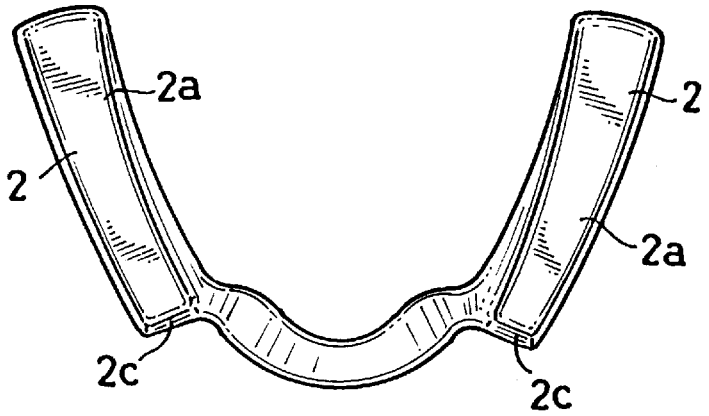
FIG. 2 is a plan view of the same molar protector.
Figure 3:
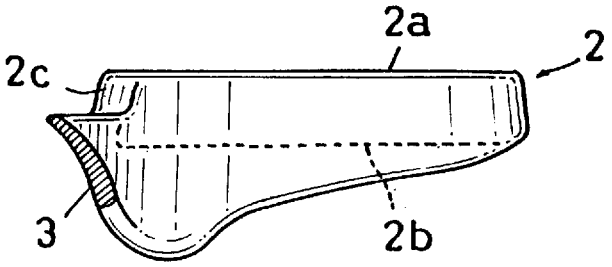
FIG. 3 is a sectional elevation view of the same molar protector.

FIG. 1 shows the embodiment in which the molar protecting portion is a three-layer structure consisting of said top layer 21, bottom layer 23, and intermediate layer 25 as disposed in the sandwich form. FIG. 2 is a plan view of the same and FIG. 3 is a sectional view taken along the line III—III.

FIG. 4 shows the embodiment in which the inside part 22 of intermediate layer 25 is made of the same easily softenable material as said top layer 21 and bottom layer 23.

FIG. 5 shows the embodiment in which the inside part 22 and outside part 24 of said intermediate layer 25 are made of the same easily softenable material as said top layer 21 and bottom layer 23.

The thermoplastic resin that can be used as said easily softenable material preferably has a comparatively low softening point (e.g. 60°–90° C.), that is to say a softening point higher than human body temperature and lower than the boiling point of water. The thermoplastic resin that can be used for this purpose includes but is not limited to polyurethane resin, silicone resin, and vinyl acetate resin. The layer or layers made of thermoplastic resin of the illustrated molar protector 1, that is to say the top and bottom layers of said three-layer structure and one of the two layers constituting the two-layer structure (the bottom layer 29 in FIG. 7 or the top layer 31 in FIG. 8) is preferably made of an ethylene-vinyl acetate copolymer which has a softening point of approximately 80° C. and an adequate post-molding flexibility. The preferred ethylene-vinyl acetate copolymer has an acetate content of 20–33 weight %.

On the other hand, the hardly softenable material for the intermediate layer of the three-layer structure or the other layer of the two-layer structure (i.e. the top layer 27 in FIG. 7 or the bottom layer 33 in FIG. 8) is a material which does not soften at temperatures below the boiling point of water, such as elastomer, silicone rubber, synthetic rubber, silicone resin, or high-temperature thermoplastic resin. Thus, for example, Mitsubishi Chemical's Rabalon MJ Series resins, Nippon Unicar's NUC-FLX NT7 Series resins, and Sumitomo Chemical's Sumitomo TPE-SB2000 Series resins can be utilized.

In this connection, ethylene-vinyl acetate copolymers varying in acetate content may be used for the top and bottom layers on the one hand and the intermediate layer on the other hand, respectively, of the three-layer structure or one of the two layers on the one hand and the other layer on the other hand, respectively, of the two-layer structure. In such cases, it is so designed that the acetate content of the hardly softenable material layer is relatively low. For example, in the three-layer structure, the acetate content of the top and bottom layers is 20–33 weight % and the acetate content of the intermediate layer is 10–25 weight %. Provided, thus, between said layers a difference of at least about 5–10 weight % in acetate content.

The bilateral molar protecting portions 2, 2 are of the same configuration and disposed in symmetric relation. Each molar protecting portion 2 is generally rectangular in sectional view and its top and bottom faces 2*a*, 2*b* are respectively formed as complementary to the occlusal faces of said superior and inferior maxillary molars 4, 5 of a human being of the average build. Thus, said upper and lower faces 2*a*, 2*b* are respectively formed as planes having somewhat larger contours than those of said occlusal faces 4*a*, 5*a*. The height dimension between said superior and inferior faces 2*a*, 2*b* is determined in consideration of the thickness dimension between those two planes in wear-molding and is preferably set at 2–9 mm, more preferably set so that the thickness on the molar side is 10–15% thinner than the thickness on the premolar side. In this manner, a molar protector with a reduced foreign body sensation can be provided. Furthermore, a molar protector with a still reduced foreign body sensation can be provided by insuring that the width on the premolar side will be 10–40% smaller than the width on the molar side.

The connecting portion 3 bridges the anterior parts 2*c*, 2*c* of the bilateral molar protecting portions 2, 2, and is configured to be a thin-walled arcuate portion fitting to the posterior surface (labial side surface) 7*a* . . . of the anterior teeth 7 of the lower jaw.

When the molar protecting portion 2 is to be a three-layer structure, the manufacturing process comprises molding said molar protecting portions and connecting portion as a unit from a thermoplastic resin with an insert piece or core interposed in the intermediate position, then removing the core, and injecting a hardly softenable material, such as said silicone rubber, silicone resin, elastomer, or the like, into the void formed upon removal of the core. The direction of removal of the core will be lateral or posterior.

Figure 11A:
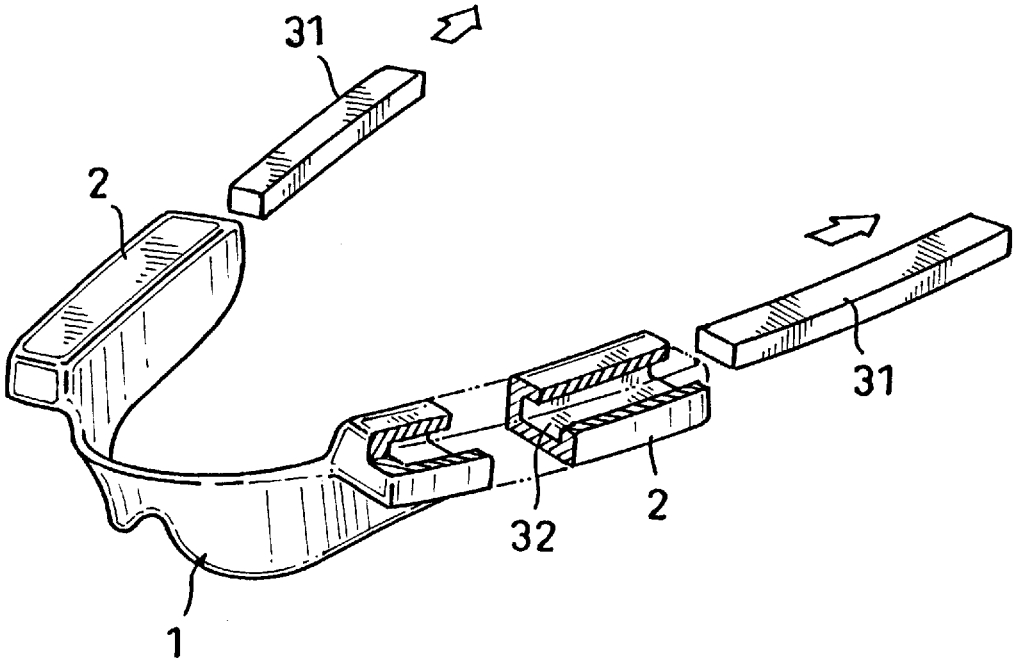
FIG. 11 is a perspective view showing the sequence of production of the molar protector according to said third embodiment of the invention.
Figure 11B:
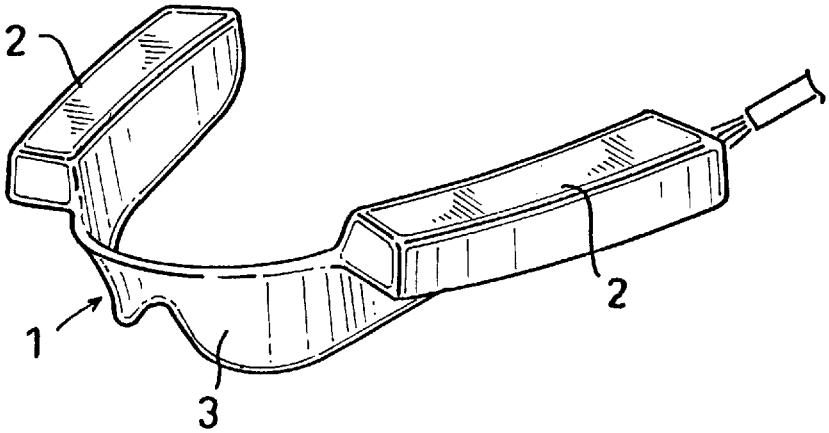

FIG. 11 shows the condition after posterior removal of the core and subsequent filling of the resulting void 32 with a hardly softenable material, e.g. silicone resin, silicone rubber, or elastomer.

Figure 12A:
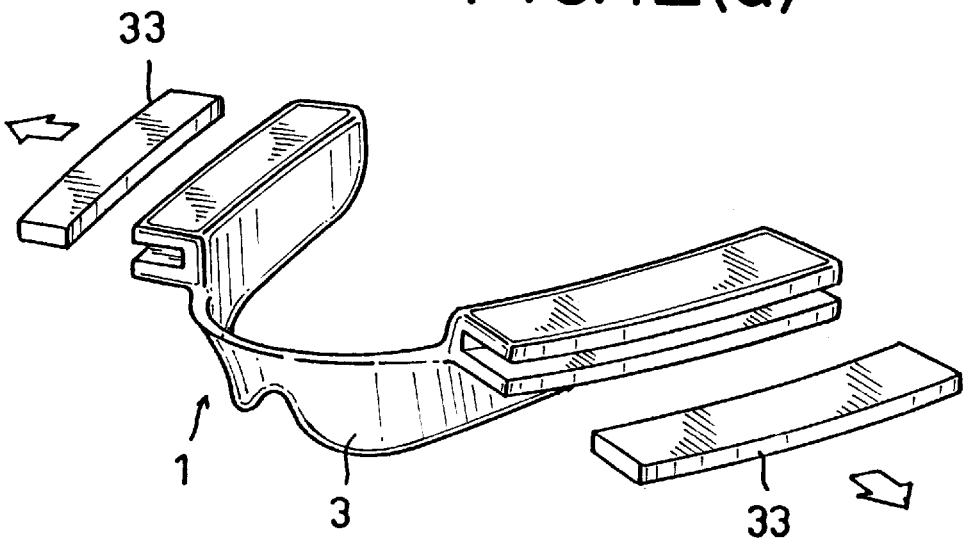
FIG. 12 is a perspective view showing the sequence of production of the molar protector according to said second embodiment of the invention.
Figure 12B:
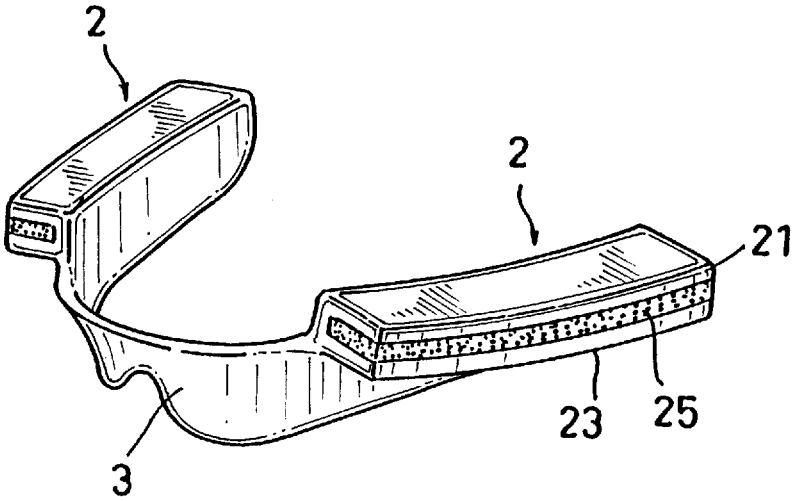

FIG. 12 shows the condition after lateral removal of the core 33 and subsequent filling of the resulting void with a hardly softenable material, e.g. elastomer, silicone rubber, synthetic rubber, silicone rubber, or high-temperature thermoplastic resin, to provide said intermediate layer 25.

The manner of wear-molding of the molar protector 1 fabricated by the method described above is now explained.

(1) When the molar protector 1 is kept immersed in hot water at about 80° C. which is the softening temperature of said easily softenable material, the layers of the molar protector 1 which are made of said easily softenable material are warmed up to said softening temperature in about 30 seconds~1 minute to become flexible.

(2) This locally softened dental protector 1 is instered into the oral cavity of the person to wear the protector (wearer) and subjected to preliminary molding.

Thus, the wearer abuts the molar protecting portions 2, 2 of the molar protector 1 against the bilateral molars 5, 5, respectively, of the lower jaw and the connecting portion against the back or labial side 7*a* . . . of the anterior teeth 7 . . . of the lower jaw as illustrated in FIG. 9 and, thereafter, presses the respective portions with fingers to bring the portions of molar protector 1 into intimate contact with said bilateral molars and said back side of anterior teeth 7 . . . for preliminary molding.

(3) With the molar protector set in the oral cavity and pre-molded in the above manner, the wearer clenches the upper and lower jaws, whereupon the molar protector 1 is wear-molded faithfully simulating his dental conformation.

Thus, by the force of clenching the upper and lower jaws, the softened layers of molar protector 1 which are made of said easily softenable material are caused to undergo plastic deformation so that the central areas of the top and bottom layers, or the central area of one or the other layer, of each of the bilateral molar protecting portions 2, 2 are molded to be complementary to the occlusal faces 4*a*, 5*a* of the superior and inferior maxillary molars 4, 5 and the marginal areas of said portions 2, 2 cover the marginal areas of said occlusal faces 4*a*, 5*a*. In this manner, the molar protector 1 is wear-molded faithfully reproducing the conformation of the wearer's dentition.

Figure 13:
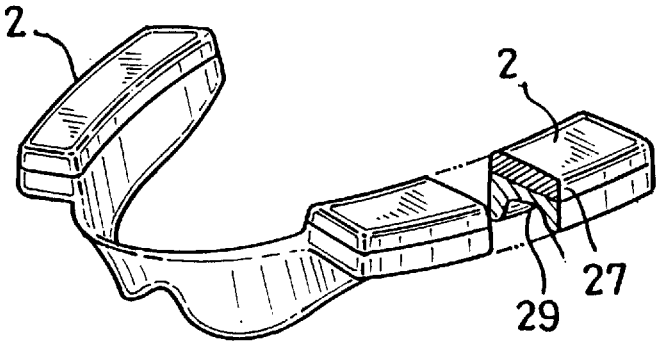
FIG. 13 is a partially exploded perspective view showing the wear-molded state of the molar protector according to said fourth embodiment of the invention.
Figure 14:
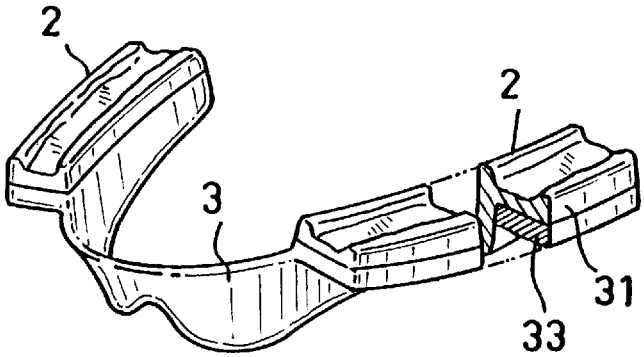
FIG. 14 is a partially exploded perspective view showing the wear-molded state of the molar protector according to said fifth embodiment of the invention.

FIGS. 13 and 14 show the wear-molding of the two-layer molar protector. In this case, the impressions reproducing the occlusal faces of either one of the superior and inferior maxillary molars are formed on either one or the other of the top and bottom layers.

By this wear-molding, the thickness dimension between said top and bottom faces 2*a*, 2*b* is decreased from 2–9 mm to 1–5 mm, preferably 2–4 mm.

(4) The molar protector 1 thus wear-molded is then cured by cooling to a temperature below said softening temperature in about 20 seconds to 1 minute, whereby the wear-molding is carried to completion.

The wear-molded molar protector 1 is refitted in the oral cavity of the wearer as illustrated in FIG. 9 and put to use in the state firmly gripped by and between the superior and inferior maxillary molars 4, 5 . . . , so that the molars are protected by the adequate inherent elasticity of the molar protector 1. Since the molar protector 1 has a layer made of said hardly softenable material, it does not happen that the molar protecting portions are bitten off by the molars of the upper and lower jaws even if the protector 1 is clenched with a great force, thus insuring a very satisfactory molar protecting effect.

In accordance with this invention providing the above-mentioned meritorious effect, it is possible to provide a molar protector which is readily available to the sporting public, not to speak of professional athletes, and closely fitting to the dentition of the individual wearer. In addition, this molar protector can be wear-molded by forceful clenching prior to use and, in use, it does not happen that its molar protecting portions are bitten off by the clenched molars to lose the molar protecting effect.

(1) Since either the top layer or the bottom layer, or both layers, of the molar protecting portion are made of thermoplastic resin, a molar protector closely fitting to the molars of the wearer himself can be self-made by immersing the protector in hot water at a temperature near the softening point of said resin to soften the corresponding portion, positioning it in the oral cavity, and clenching it between the upper and lower jaws.

Therefore, compared with the conventional template, the manufacturing process is considerably simplified and the manufacturing time drastically curtailed.

(2) Furthermore, the wear-molding step does not require any extraordinary art or skill and the softening temperature is low enough to be attained using the hot water readily available at home. Therefore, the molar protector can be wear-molded at home without attending the dental clinic to have it tailored. Thus, quality molar protectors can be readily made available to the sporting public, not to speak of professional athletes.

(3) The wear-molding operation, which does not require any special art or skill, yields the optimum molar protector for each individual and if it is deformed by repeated use, it can be softened again in hot water and refitted to one's own dentition.

(4) Since the molar protector of the invention has all the basic structural features necessary for fitting to the dentition of the wearer and can be wear-molded at the individual level, it lends itself well to mass production for drastic cost reduction, thus making it possible to supply molar protectors at prices well within reach of the general sporting public.

(5) Since the optimum molar protector for each wearer's dentition can be fabricated, the protection of the molars at exertions can be well insured with little foreign body sensation. Moreover, because the molars can be fully clenched, the muscular forces can be deployed effectively at a stroke. Taking the dorsal muscle power as an example, it has been experimentally demonstrated that wearing of the molar protector of the invention results in an improvement in dorsolumbar myodynamometric reading as compared with the control without the protector.

(6) Since the intermediate layer of the three-layer structure or either the top or the bottom layer of the two-layer structure is made of an elastic, hardly softenable material such as elastomer, silicone rubber, synthetic rubber, silicone resin or high-temperature thermoplastic resin, forceful clenching of the teeth at wear-molding or in use of the molar protector does not result in tearing or thinning of the molar protecting portions so that the necessary impression of molars can be made for wear-molding without apprehension. Moreover, the molar protector can be used without fear of biting-off of the molar protecting portions owing to clenching of the molars during exercise.

(7) Furthermore, when the molar protecting portions are of the two-layer structure and one of the component layers is made of an elastic, hardly softenable material such as elastomer, silicone rubber, synthetic rubber, silicone resin, or high-temperature thermoplastic resin, an adequate impression of molars can be made in the easily softenable thermoplastic resin layer to fit the molar protecting portions to the wearer's molars, while the molars on the side of the hardly softenable material can be freely moved both posteroanteriorly and inferiosuperiorly to minimize the interference of the protector with speech so that no inconvenience is felt even during sporting activity lasting many hours.

What is claimed is:

1. A molar protector comprising a pair of right and left molar protecting portions each having top and bottom faces complementary to the occlusal faces of the corresponding superior and inferior maxillary molars and a connecting portion bridging said molar protecting portions, said connecting portion being configured to be a thin-walled arcuate portion fitting to the posterior surface of the anterior teeth of the lower jaw, said top and bottom faces being respectively formed as planes having somewhat larger contours than those of said occlusal faces, each of said molar protecting portions comprising a top layer, a bottom layer, and an intermediate layer interposed between said top and bottom layers, said top layer and bottom layer being respectively made of an easily softenable material, the softening point of which is higher than human body temperature and lower than the boiling point of water, such as a thermoplastic resin, and said intermediate layer being made of an elastic, hardly softenable material which does not soften at temperatures below the boiling point of water, such as elastomer, silicone rubber, synthetic rubber, silicone resin, or high-temperature thermoplastic resin.

2. A molar protector as recited in claim 1, in which the width on the premolar side of said molar protecting portion is 10–40% smaller than that on the molar side.

3. A molar protector comprising a pair of right and left molar protecting portions each having top and bottom faces complementary to the occlusal faces of the corresponding superior and inferior maxillary molars and a connecting portion bridging said molar protecting portions, said connecting portion being configured to be a thin-walled arcuate portion fitting to the Posterior surface of the anterior teeth of the lower jaw, said top and bottom faces being respectively formed as planes having somewhat larger contours than those of said occlusal faces, each of said molar protecting portions comprising a top layer, a bottom layer, and an intermediate layer interposed between said top and bottom layers, one or the other of said molar protecting portions being made of an easily softenable material, the softening point of which is higher than human body temperature and lower than the boiling point of water, such as a thermoplastic resin, and one or the other of said top and bottom layers being made of an elastic, hardly softenable material which does not soften at temperatures below the boiling point of water, such as elastomer, silicone rubber, synthetic rubber, silicone resin, or high-temperature thermoplastic resin.

4. A molar protector as recited in claim 3, in which the width on the premolar side of said molar protecting portion is 10–40% smaller than that on the molar side.

5. A method of producing a molar protector having a pair of right and left molar protecting portions each having top and bottom faces complementary to the occlusive faces of the corresponding superior and inferior maxillary molars and a connecting portion bridging said molar protecting portions, said connecting portion being configured to be a thin-walled arcuate portion fitting to the posterior surface of the anterior teeth of the lower jaw, said top and bottom faces respectively formed as planes having somewhat larger contours than those of said occlusal faces, which comprises molding said molar protecting portions with provision of an internal void in each of said molar protecting portions from an easily softenable material, the softening point of which is higher than human body temperature and lower than the boiling point of water, such as a thermoplastic resin, and thereafter filling said void with an elastic, hardly softenable material which does not soften at temperatures below the boiling point of water, such as elastomer, silicone rubber, synthetic rubber, silicone resin, or high-temperature thermoplastic resin.

6. A method of producing a molar protector having a pair of right and left molar protecting portions each having top and bottom faces complementary to the occlusive faces of the corresponding superior and inferior maxillary molars and a connecting portion bridging said molar protecting portions, said connecting portion being configured to be a thin-walled arcuate portion fitting to the posterior surface of the anterior teeth of the lower jaw, said top and bottom faces being respectively formed as planes having somewhat larger contours than those of said occlusal faces, which comprises molding said molar protecting portions each with provision of a laterally open void in an intermediate layer thereof from an easily softenable material, the softening point of which is higher than human body temperature and lower than the boiling point of water, such as a thermoplastic resin and interposing an elastic, hardly softenable material which does not soften at temperatures below the boiling point of water, such as elastomer, silicone rubber, synthetic resin, silicone resin, or high-temperature thermoplastic resin, in said void in said intermediate layer.

* * * * *